US007641088B2

(12) United States Patent
Wang

(10) Patent No.: US 7,641,088 B2
(45) Date of Patent: Jan. 5, 2010

(54) NAIL GUN WITH NAIL ALIGNMENT ADJUSTMENT DEVICE

(75) Inventor: Kuan-Ho Wang, Tali (TW)

(73) Assignees: Nailermate Enterprise Corporation, Tali (TW); Chung-Chih Wei, Taiping (TW)

( * ) Notice: Subject to any disclaimer, the term of this patent is extended or adjusted under 35 U.S.C. 154(b) by 105 days.

(21) Appl. No.: 12/052,786

(22) Filed: Mar. 21, 2008

(65) Prior Publication Data

US 2009/0236386 A1 Sep. 24, 2009

(51) Int. Cl.
*B25C 1/00* (2006.01)

(52) U.S. Cl. ..... 227/119; 227/8; 227/130; 227/142

(58) Field of Classification Search ..... 227/8, 227/119, 130, 142
See application file for complete search history.

(56) References Cited

U.S. PATENT DOCUMENTS 5,263,842 A * 11/1993 Fealey ..... 227/8
6,454,151 B1 * 9/2002 Wang-Kuan ..... 227/8
6,705,501 B2 * 3/2004 Miller et al. ..... 227/8
RE38,834 E * 10/2005 Perra ..... 173/8
7,140,524 B2 * 11/2006 Hung et al. ..... 227/8

* cited by examiner

*Primary Examiner*—Stephen Garbe
*Assistant Examiner*—Nathaniel Chukwurah
(74) *Attorney, Agent, or Firm*—Alan Kamrath; Kamrath & Associates PA

(57) ABSTRACT

A nail gun includes a housing having a first locking element, an opposite second locking element, and a sliding groove, a safety mechanism including an actuation member in the sliding groove, the actuation member having an end nose, and a nail alignment adjustment mechanism including a lever pivotably secured to the housing, a spring having a first end secured to the other end of the lever and a second end affixed to the actuation member, and a spring-biased selector including a shank passing the lever, and a knob secured to the shank. Pivoting the knob from a first position to a second position will cause the nose to contact a first workpiece. Pivoting the knob from the second position to the first position will cause the nose to dispose above a second workpiece and align a nail with a through hole of the second workpiece.

4 Claims, 7 Drawing Sheets

NAIL GUN WITH NAIL ALIGNMENT ADJUSTMENT DEVICE

BACKGROUND OF THE INVENTION

1. Field of Invention

The invention relates to pneumatic nail guns and more particularly to such a nail gun having a device which is adapted to adjust an actuation member of a safety mechanism based on whether there is through hole in a front (or top) workpiece so that the point of a nail can be quickly adjusted to align with the through hole prior to driving the nail into the front workpiece and a rear (or bottom) workpiece to fasten them together.

2. Description of Related Art

A nail gun is adapted to drive a nail into a front workpiece and a rear workpiece to secure them together. The workpiece can be wood, metal plate, etc. Conventionally, nail guns having a safety mechanism are particularly suitable to drive nails into wood.

In often times the front workpiece is a metal plate. Thus, it is difficult of driving a nail into the front metal plate and the rear wood by means of the nail gun. It is typical of drilling a through hole in the metal plate prior to using the nail gun. However, the safety mechanism of the nail gun may contact the front metal plate. As a result, it is hardly aligning a nail with a through hole in the metal plate. Thus, continuing improvements in the exploitation of nail gun with nail alignment adjustment device are constantly being sought.

SUMMARY OF THE INVENTION

It is therefore one object of the invention to provide a nail gun comprising a housing including an extending handle being in an angular position relative to the housing, a first locking element, a second locking element opposing the first locking element, and an elongated sliding groove extending out of the housing, a safety mechanism including an actuation member mounted in the sliding groove, the actuation member having a nose at a free end thereof, and a nail alignment adjustment mechanism comprising a lever having one end pivotably secured to the housing; a spring having a first end secured to the other end of the lever and a second end affixed to the actuation member; and a spring-biased selector including a shank passing through the lever, and a knob secured to an open end of the shank, the knob having a lock member, whereby disengaging the lock member from the first locking element at a first position and pivoting the knob to a second position to lockingly engage the lock member with the second locking element will cause the nose to contact a first workpiece; and whereby disengaging the lock member from the second locking element at the second position and pivoting the knob to the first position to lockingly engage the lock member with the first locking element will cause the nose to dispose above a second workpiece and align a nail with a through hole of the second workpiece.

In one aspect of the invention the first workpiece is a wooden plate and the second workpiece is a metal plate respectively.

In another aspect of the invention the first locking element comprises a first projection and a first trough adjacent the first projection, and the second locking element comprises a second projection and a second trough adjacent the second projection respectively.

The above and other objects, features and advantages of the invention will become apparent from the following detailed description taken with the accompanying drawings.

DETAILED DESCRIPTION OF THE INVENTION

Figure 1:
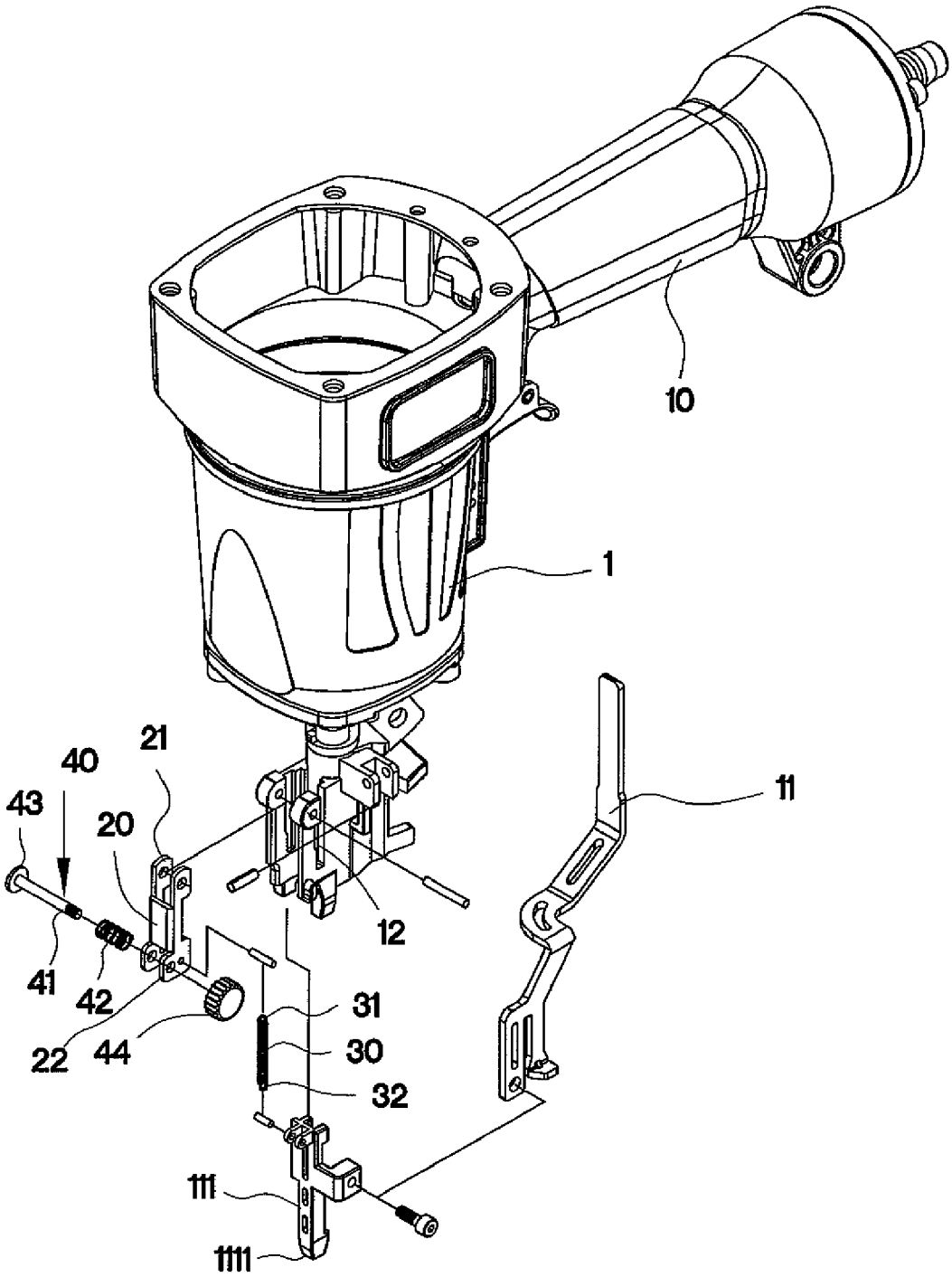
FIG. 1 is an exploded view of a nail alignment adjustment device for nail gun according to the invention.
Figure 2:
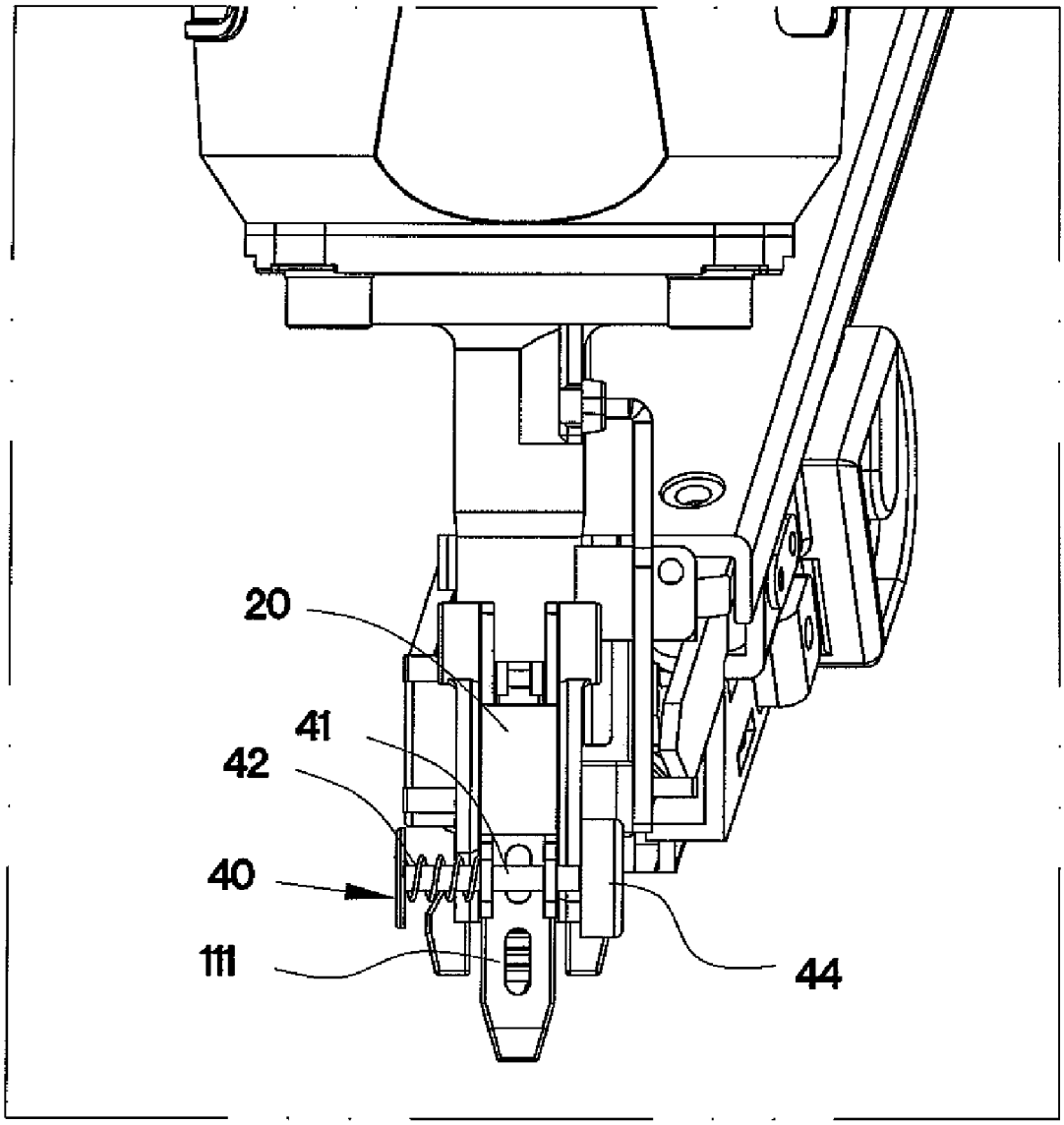
FIG. 2 is a front view of the assembled nail alignment adjustment device in its first adjusting mode.
Figure 3:
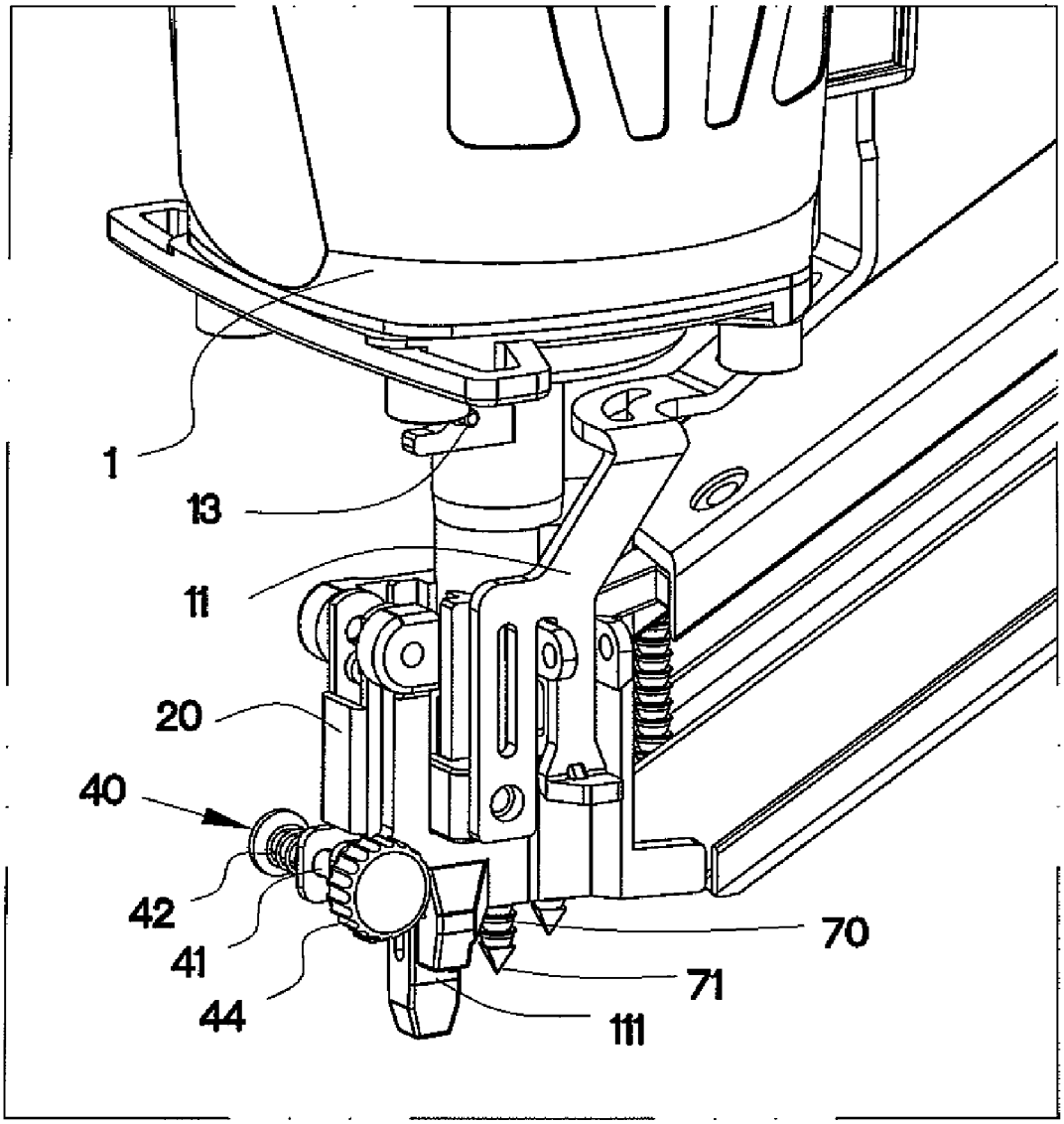
FIG. 3 is a perspective view of FIG. 2.
Figure 4:
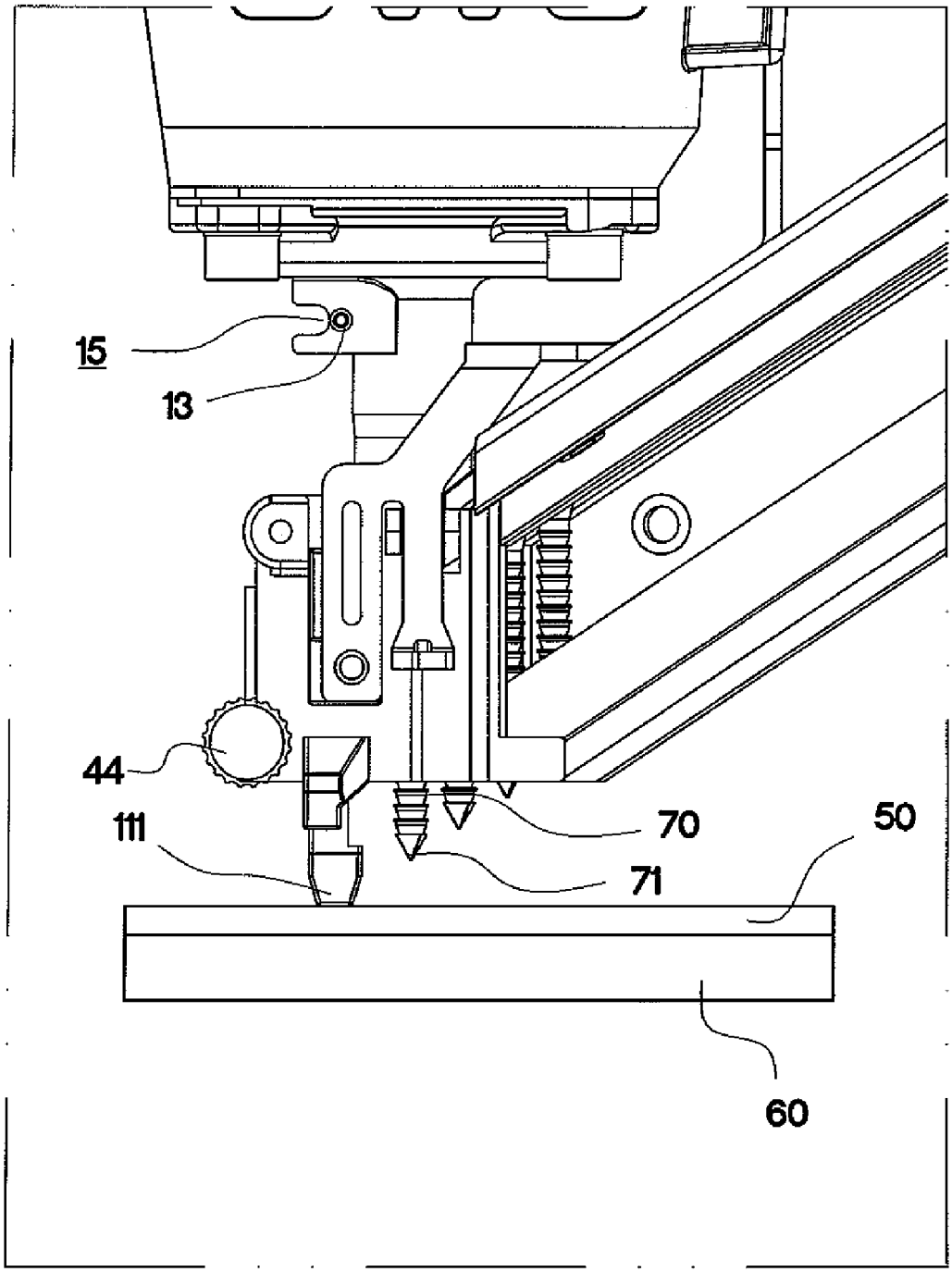
FIG. 4 is a side elevation of FIG. 2 where the actuation member contacts the top workpiece.

Referring to FIGS. 1 to 7, a nail gun having a nail alignment adjustment device in accordance with the invention is shown. The nail gun comprises the following components.

A housing 1 has an extending handle 10 being in an angular position relative to the housing 1 and a downward sliding groove 12. A safety mechanism 11 has an actuation member 111 mounted in the sliding groove 12. The actuation member 111 has a nose 1111 on its free end.

A lever 20 has one yoke end 21 pivotably secured to the housing 1 and the other free end 22 secured to a first end 31 of a first spring 30 which has a second end 32 affixed to the actuation member 11.

A selector 40 comprises a shank 41 passing through the lever 20 and a second spring 42 with the second spring 42 being compressed between an enlarged head 43 of the shank 41 and the lever 20, and a knob 44 secured to an open end of the shank 41. The knob 44 has a positioning furrow (not shown). Note that the number of the positioning furrow may be more than one in other embodiments. An upper projection 13 is provided proximate an underside of the housing 1 and a lower projection 14 is provided proximate the nose 1111 of the actuation member 111 respectively. Also, an upper trough 15 is provided adjacent the upper projection 13 and a lower trough 16 is provided adjacent the lower projection 14 respectively.

Referring to FIGS. 2 to 5 specifically, a first adjusting mode of the nail alignment adjustment device is shown. A top workpiece (e.g., wood) 50 is placed on a bottom workpiece (e.g., wood) 60 and both workpieces 50, 60 have no through hole formed therein. A user may downward pivot the knob 44 about the yoke end 21 to move the knob 44 from a first position at the upper projection 13 (see FIG. 5) to a second position at the lower projection 14 (see FIG. 3) with the actuation member 111 being pushed downward by the first spring 30. As a result, the actuation member 111 is at an elevation lower than that of the tip 71 of a nail 70.

Figure 6:
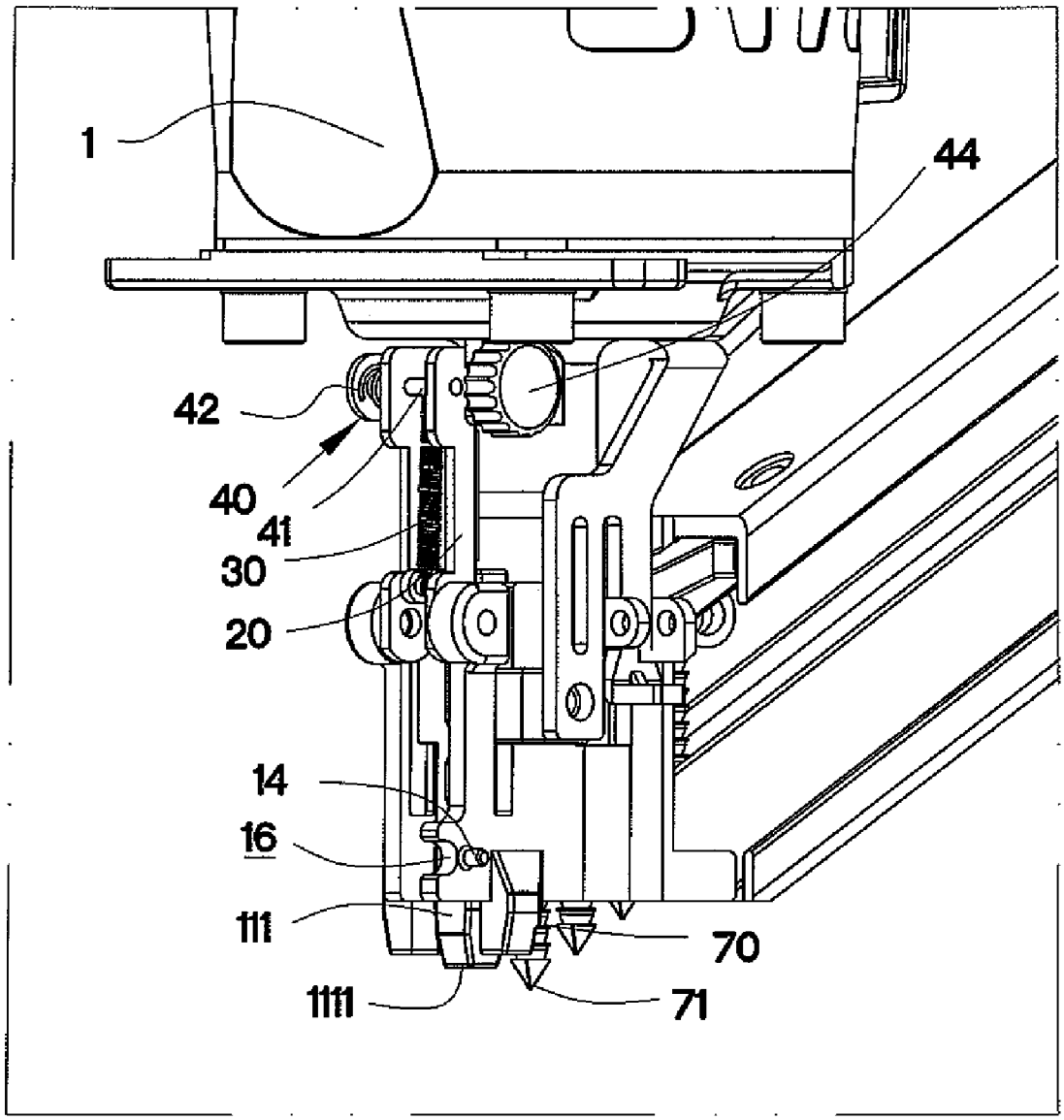
FIG. 6 is a perspective view of FIG. 5.

Thereafter, pull the knob 44 to bring the shank 41 to be close to the lower trough 16 (see FIG. 6). Next, release the knob 44 to cause the second spring 42 to release its stored elastic force to engage the positioning furrow of the knob 44 with the lower projection 14 (see FIG. 6). As such, the lever 20 is locked with the actuation member 111 being in contact with the top workpiece 50. Finally, the user may press a trigger to discharge a nail which is driven into both the top and bottom workpieces 50, 60 to secure them together. It is noted that no nail alignment is required in the first adjusting mode of the nail alignment adjustment device.

Figure 5:
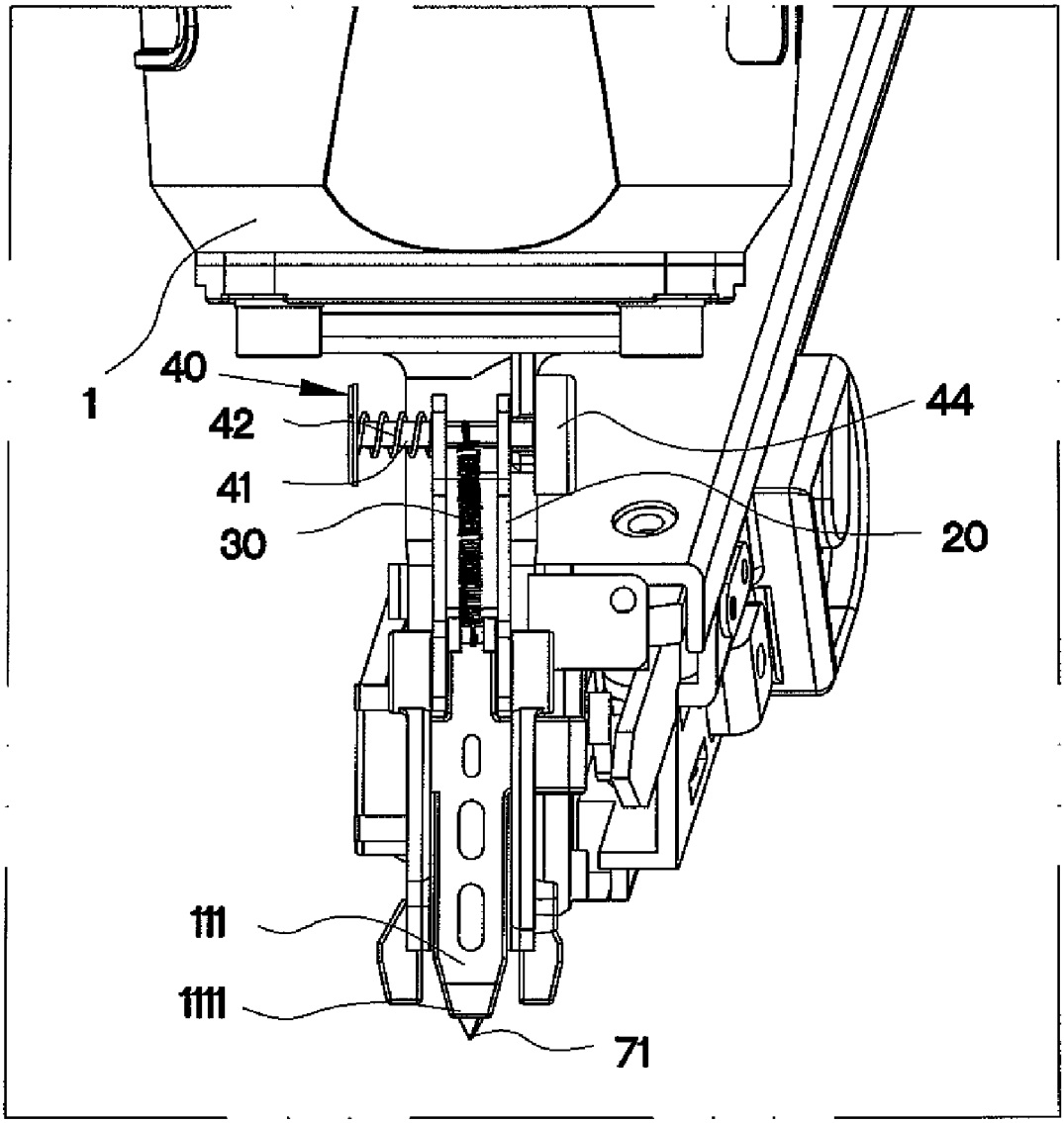
FIG. 5 is a front view of the assembled nail alignment adjustment device in its second adjusting mode.
Figure 7:
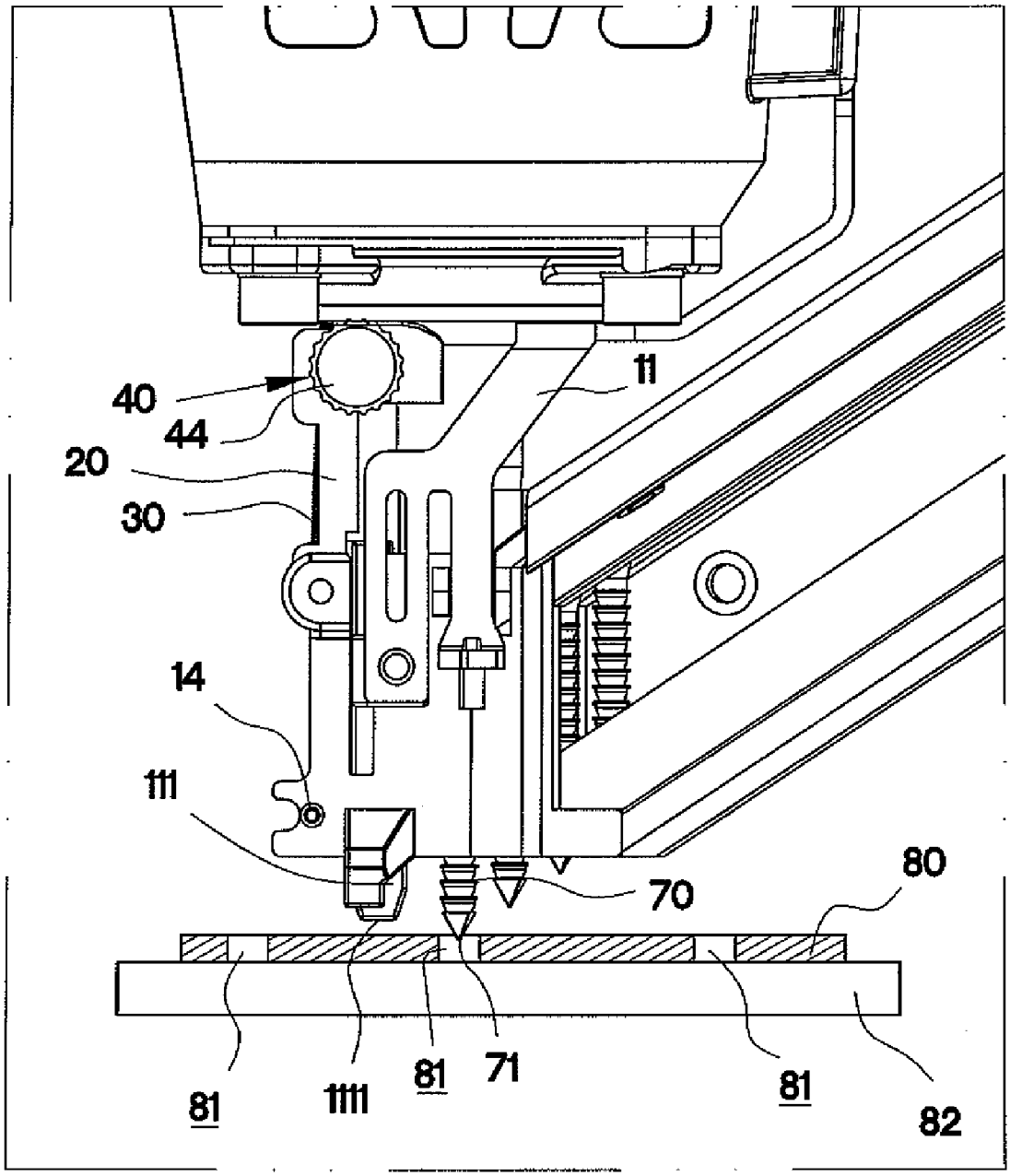
FIG. 7 is a side elevation of FIG. 5 where the actuation member is disposed above the top workpiece and the tip of a nail is aligned with a through hole in the top workpiece.

Referring to FIGS. 5 to 7 specifically, a second adjusting mode of the nail alignment adjustment device is shown. The characteristics of the second adjusting mode are detailed below. A top workpiece 80 is a metal plate and is formed with a through hole 81. A user may upward pivot the knob 44 about the yoke end 21 to move the knob 44 from the second position at the lower projection 14 to the first position at the upper projection 13 (see FIG. 6) with the lever 20 being pivoted upward and the actuation member 111 being pulled upward by the first spring 30. As a result, the actuation member 111 is at an elevation higher than that of the tip 71 of a nail 70 (see FIG. 7).

Thereafter, pull the knob 44 to bring the shank 41 to be close to the upper trough 15. Next, release the knob 44 to cause the second spring 42 to release its stored elastic force to engage the positioning furrow of the knob 44 with the upper projection 13 (see FIG. 4). As such, the lever 20 is locked with the actuation member 111 being disposed above the top workpiece 80. Finally, the user may press a trigger to discharge a nail which is driven into both the through hole 81 of the top workpiece 80 and the bottom workpiece (e.g., wood) 82 to secure them together. It is noted that the nail alignment is quick in second adjusting mode of the nail alignment adjustment device, resulting in an increase of performance. Most importantly, this operation is safe.

While the invention herein disclosed has been described by means of specific embodiments, numerous modifications and variations could be made thereto by those skilled in the art without departing from the scope and spirit of the invention set forth in the claims.

What is claimed is:

1. A nail gun comprising a housing including an extending handle being in an angular position relative to the housing, a first locking element having a first projection, a second locking element opposing the first locking element and having a second projection, and an elongated sliding groove extending out of the housing, a safety mechanism including an actuation member mounted in the sliding groove, the actuation member having a nose at a free end thereof, and a nail alignment adjustment mechanism comprising:

a lever having one end pivotably secured to the housing;

a spring having a first end secured to the other end of the lever and a second end affixed to the actuation member; and a spring-biased selector including a shank passing through the lever, and a knob secured to an open end of the shank, the knob having a lock member, whereby disengaging the lock member from the first projection of the first locking element at a first position and pivoting the knob to a second position to lockingly engage the lock member with the second projection of the second locking element will cause the nose to contact a first workpiece; and whereby disengaging the lock member from the second locking element at the second position and pivoting the knob to the first position to lockingly engage the lock member with the first locking element will cause the nose to dispose above a second workpiece and align a nail with a through hole of the second workpiece.

2. The nail gun of claim 1, wherein the first workpiece is a wooden plate and the second workpiece is a metal plate respectively.

3. The nail gun of claim 1, wherein the lock member comprises one or more positioning furrows.

4. The nail gun of claim 1, wherein the first locking element further comprises a first trough adjacent the first projection and the second locking element further comprises a second trough adjacent the second projection respectively.

* * * * *